US005373648A

United States Patent [19]

Wolf

[11] Patent Number: 5,373,648

[45] Date of Patent: Dec. 20, 1994

[54] PROCESS AND DEVICE FOR DRYING SOLID MATERIALS IN AN INDIRECTLY HEATED FLUIDIZED BED

[75] Inventor: Bodo Wolf, Freital, Germany

[73] Assignee: Uet Umwelt- und Energietechnik GmbH, Freibert, Germany

[21] Appl. No.: 30,040

[22] PCT Filed: Oct. 15, 1990

[86] PCT No.: PCT/EP90/01744

§ 371 Date: Mar. 18, 1993

§ 102(e) Date: Mar. 18, 1993

[87] PCT Pub. No.: WO92/05393

PCT Pub. Date: Apr. 2, 1992

[30] Foreign Application Priority Data

Sep. 18, 1990 [DE] Germany ..... 4029525

[51] Int. Cl.[5] ..... F26B 17/00

[52] U.S. Cl. ..... 34/578; 34/77; 34/79; 34/363; 165/104.16

[58] Field of Search ..... 34/10, 57 R, 57 A, 359, 34/360, 363, 576, 578, 591, 76, 77, 78, 79, 73, 74, 468; 110/245; 432/58; 122/4 D; 422/146; 165/104.16; 366/101, 106, 107

[56] References Cited

U.S. PATENT DOCUMENTS

| | | | |
|---|---|---|---|
| 3,790,334 | 2/1974 | Cohen | 34/57 R |
| 3,800,427 | 4/1974 | Kemmetmueller | 34/10 |
| 3,861,054 | 1/1975 | Stahl | 34/10 |
| 4,304,049 | 12/1981 | Curtius | 34/10 |
| 4,563,151 | 1/1986 | Vogel | 432/58 |

FOREIGN PATENT DOCUMENTS

| | | |
|---|---|---|
| 203059 | 11/1986 | European Pat. Off. . |
| 2245495 | 4/1974 | Germany . |
| 2901723 | 8/1979 | Germany . |
| 2912429 | 1/1980 | Germany . |
| 3600400 | 7/1987 | Germany . |
| 3912586 | 11/1989 | Germany . |
| 3943366 | 10/1990 | Germany . |

*Primary Examiner*—Denise L. Gromada
*Attorney, Agent, or Firm*—Foley & Lardner

[57] ABSTRACT

A process and apparatus are disclosed for drying solid materials, which allows the thermal energy used for drying to be recovered and the emissions produced during degassing and gasification to be reduced. A solid material which contains an evaporable material, particularly water, is fed to a fluidized bed drier. The solid material is fluidized by fluidizing medium, the fluidizing medium being the evaporable material. The dried solid material is removed from the drier and is fed to further processing, use or disposal. The non-condensable components of the solid material which are insoluble in the condensate of the evaporable material are separated by cooling and condensation of the vapor and released for subsequent use or disposal. The temperature of the fluidized bed is regulated by introducing solid material with a higher content of evaporable material, and by removing the dried solid material from, the fluidized bed, such that the temperature corresponds to the boiling curve of the evaporable material of the solid material removed from the fluidized bed. Therefore, the vapor removed from the fluidized bed contains gaseous substances of the evaporable material, other gaseous impurities and only gaseous components of the solid constituents of the solid material which are volatile below the boiling curve.

17 Claims, 1 Drawing Sheet

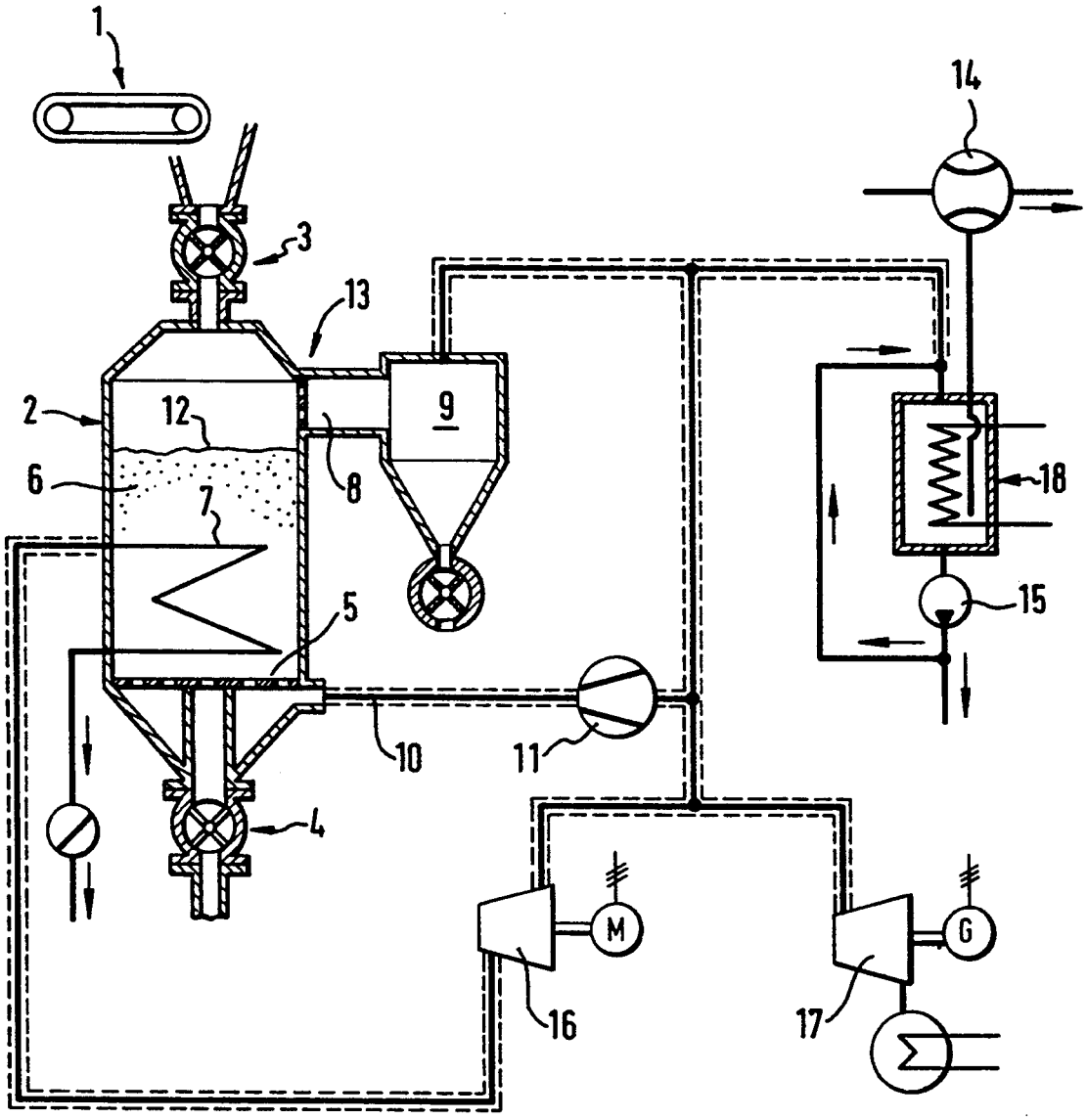
1
2
3
4
5
6
7
8
9
10
11
12
13
14
15
16
17
18
M
G

PROCESS AND DEVICE FOR DRYING SOLID MATERIALS IN AN INDIRECTLY HEATED FLUIDIZED BED

BACKGROUND OF THE INVENTION

1. Field of the Invention

The invention relates to a process and a device for drying solid materials, such as, for example, brown coal, peat, sand, filter cakes from mechanical separation processes and sludges which contain less than 98% % by weight [sic] of an evaporable material, for example water, in which an indirectly heated fluidized bed is formed and contains solid material fluidized by a fluidizing medium, the fluidizing medium being the evaporable material in vapor form, and in which the dried material discharged from the fluidized-bed drier can be fed, if required after cooling, for further processing, utilization or disposal in a landfill, but the evaporated material can be fed to a purification, cooling, physical utilization and/or heat recovery stage and is suitable for use in industry, the building industry, agriculture and communal disposal.

2. Description of Related Art

Drying processes, in particular those which separate off water as an evaporable component from solid materials, are of considerable economic and social importance for industrial production, the building industry, energy conversion and disposal in communities and plants. In some cases, the drying is so much a matter of course and so integrated in the process sequences, as in the combustion of water-containing fuels, for example brown coal, and of sludges, that the environmental pollution caused by it through increased energy demand and increased emission are regarded as quite natural.

For the utilization of crude brown coal for energy, milling/drying plants are employed, particularly in power stations, said plants sucking back a part of the furnace gas, produced in the furnace, as a heat energy medium for the milling/drying, so that the water in the coal evaporates as a result of heat transfer by furnace gas at 800° to 1000° C. with crude brown coal in the stack gas stream, before or during milling of the coal to form pulverized fuel. The relevant prior art is described in detail in the book by Effenberger, H. "Dampferzeuger" [Steam generators], VEB Verlag für Grundstoffindustrie, 1st Edition, 1987. Based on the heat energy liberated in the furnace of the boiler, this method of drying causes more than 1.5 times the minimum stack gas emission required on the basis of the laws of nature, owing to the high intrinsic fuel requirement of the drying and the proportion of steam in the stack gas.

In the brown coal enrichment, disk and tubular rotary driers indirectly heated with steam, i.e. contact driers, are predominantly used, as described in detail by Krug and Nauendorf in the book "Braunkohlenbrikettierung" [Briquetting of brown coal] Volume 1, section on Drying, VEB Deutscher Verlag für Grundstoffindustrie, Leipzig, 1984, 1st Edition.

By using steam from tapped turbines or back-pressure steam as a heat medium for the drying, which, through condensation, transfers its latent heat energy indirectly to the coal after it has been converted into saturated steam, for example by injection of condensate, the known principle of "Power/Heat coupling" is utilized and a reduction in the fuel requirement to be attributed to the drying is achieved. Compared with the milling/drying conventionally used in the brown coal power stations, it was therefore possible to reduce the comparable sum of the stack gas emission occurring during the individual enrichment and utilization sections to approximately 1.3 times the minimum required on the basis of the laws of nature. However, since "entrained air" is used in most cases, these advantages are not effective.

The introduction of indirectly heated disk and tubular rotary driers and hence the development of power/heat coupling, for example in brown coal and peat power stations, have been unsuccessful to date since the required fuel mass flows and the limited capacity of such driers are in contradiction with one another and have not permitted the object to be achieved in an economical manner.

East German Patent 67,770 discloses a process and a means for the predrying of water-containing solid fuels, in particular of soft brown coal, in which the drying of brown coal before its combustion in a steam boiler is carried out in a fluidized-bed drier directly heated with steam. As in the case of the disk and tubular rotary driers, steam from tapped turbines or back-pressure steam should be used here and hence the principle of power/heat coupling utilized.

In East German Patent 67,770, it is assumed that every suitable fluidizing medium, i.e. including steam, can be used for fluidizing the brown coal above the fluidization base in the fluidized-bed drier.

U.S. Pat. No. 3,800,427 describes an indirectly heated fluidized-bed drying process in which the brown coal is fluidized with steam so that the drying takes place in a steam atmosphere. However, the invention assumes that the brown coal is heated in the steam atmosphere to such an extent that the sulfur compounds are eliminated and undergo addition with additives which may be simultaneously present in the fluidized bed.

German Patent 2,901,723 extends the use of a fluidized bed indirectly heated with steam and fluidized with steam generally to include the drying of solid materials which contain less than 95% by weight of an evaporable material. In addition to water, the evaporable material may also be other materials, such as solvents, which in their vapor form are a fluidizing medium and in their saturated vapor form, with utilization of different partial pressures, are also heat media for the indirect heating of the fluidized bed.

Compared with U.S. Pat. No. 3,800,427, German Patent 2,901,723 restricts the permitted temperature of the fluidized bed and specifies that it is essentially below the decomposition temperature of the solid material, so that the vapor removed from the fluidized-bed drier should consist of the evaporable material, essentially without contamination by other gaseous substances.

Research and development work over several years has shown that the process disclosed in German Patent 2,901,723 is not technically realizable in the form described. It has been found in particular that the temperature of the fluidized bed cannot be freely chosen, and that the gaseous impurities of the evaporable material are contained completely in the vapor of the evaporable material emerging from the fluidized-bed drier, practically independently of the fluidized-bed temperature.

SUMMARY OF THE INVENTION

The object of the invention is to recover the predominant proportion of the heat energy employed for the drying or to reduce the emissions produced during drying by vaporization, evaporation, pyrrolysis, degassing and gasification, in particular those which are not condensable at ambient temperature.

It is the object of the invention, while taking into account the technically realizable and implementable principles of drying technology, to provide a process, and the device required for realizing the process, for drying solid materials in a fluidized-bed drier whose indirectly heated fluidized bed is preferably formed by the dried solid material itself and is fluidized by the evaporable material in vapor form, said process and said device achieving the object of the invention during operation in practice.

Decisive for achieving the object is the knowledge acquired to the effect that the conversion of the evaporable component of a solid material or of a sludge into its vapor form in a gas phase, which is formed by the evaporable component of the solid material, is dependent, under isobaric process conditions, on a boiling curve of the material to be evaporated, which curve characterizes the solid material, i.e. is substance-specific, and fixes the required temperature of the solid material as a function of the proportion of the evaporable material in the solid material.

According to the invention, the temperature of the fluidized bed is therefore adjusted depending on the desired proportion by weight of evaporable material in the solid material discharged from the fluidized bed, by adding solid material of a higher proportion by weight of evaporable material to the fluidized bed and removing dried solid material from the fluidized bed, so that said temperature corresponds to the substance-specific boiling point of the evaporable material in the solid material removed from the fluidized bed, so that the vapor removed from the fluidized-bed drier also contains the gaseous substances of the evaporable material and other gaseous impurities which, for example, are introduced with the solid material into the fluidized-bed drier, but only those components of the solid constituents of the solid material or of the sludges which are volatile below this boiling point.

It is furthermore according to the invention that the vapor removed from the fluidized-bed drier is cooled indirectly so that it condenses with release of its latent heat energy, and the gaseous substances of the evaporable material which are contained in the vapor, other gaseous impurities and decomposition products of the solid component which are not condensable at ambient temperature and are insoluble in the condensate of the evaporable material separate from the vapor and are then released into the environment or to a landfill and/or to another gas purification.

BRIEF DESCRIPTION OF THE DRAWING

FIG. 1 shows a schematic view of the apparatus according to the present invention.

DETAILED DESCRIPTION OF THE PREFERRED EMBODIMENTS

Normally, the process according to the invention requires that the solid material to be dried be provided in particulate form, preferably having a particle size of 0 to 10 mm, i.e. as fluidizable bulk material.

Solid material, in particular sludge products which are not directly suitable for the production of a fluidizable bulk material, can be converted by admixing already dried solid material into a consistency which permits the production of a material which meets the requirements of the process. Another method for converting solid material to be dried into a form corresponding to the process consists in transforming it, with condensate of the evaporable material, into a pumpable and sprayable sludge form. It is necessary to maintain the large particle size of the solid material to be dried; in this case, the process can be successfully realized if the fluidized bed is formed not by the solid material itself but by a smaller-particle solid material which is characterized by a density which is 1.2 to 5.0 times that of the material to be dried.

In this case, it must be assumed that bed material is discharged from the fluidized bed together with the dried solid material. This necessitates separation of the bed material from the dried, coarse-particled solid material and recycling of the bed material into the fluidized bed. Particularly during steady-state operating phases in the operation of the process according to the invention, it may be necessary, as an alternative to the recycling of evaporable material in vapor form, or in addition, to introduce the fluidizing medium into the fluidized-bed drier from outside, for example from a separate system.

Decisive for the efficiency of the process is the temperature difference between the required temperature of the fluidized bed and the condensation temperature of the heating vapor used for indirect heat transfer, which, according to the invention, is preferably between 10 and 150 K. At a pressure in the fluidized-bed drier which approximately corresponds to the ambient pressure of the atmosphere, this requires heating vapor pressures of 0.2 to 4.0 MPa, which results in vapor temperatures of 125° to 225° C. when steam is used as a heating medium, with the heating vapor in a slightly overheated state. While high heating vapor pressures permit the construction of small driers, low heating vapor pressures and hence small temperature differences between condensing vapor and fluidized bed ensure good utilization of the advantages of power/heat coupling.

The recovery of the predominant proportion of the heat energy used for the drying, which recovery corresponds to the object of the invention, and the separation of the gaseous, non-condensable impurities which are insoluble in the condensate requires, according to the invention, the condensation of the evaporated component of the solid material. If the fluidized-bed drier operates under vapor pressures which correspond to the pressure of the surrounding atmosphere, the substance-dependent condensation temperature then determines the temperature level of the recoverable heat energy. If the material to be evaporated is water, the heat energy recovered under the conditions according to the invention can then reach a temperature of over 90° C., suitable for performing the functions of heat energy supply and preheating in industrial processes. If there is no heat energy demand at this temperature level, after being appropriately freed from dust, the steam can be expanded with performance of technical work, to such an extent that condensation is still possible at ambient temperature.

A further possibility consists of increasing the pressure of the vapor from the fluidized-bed drier, likewise after appropriate removal of dust, before its condensation by compression, to such an extent that the heat of condensation is obtained at a temperature level which is sufficient for fulfilling the intended heat transfer, for example for heating the fluidized bed of the process according to the invention.

To realize the process according to the invention, an apparatus is provided as shown in FIG. 1. A means 1 for feeding the solid material to be dried into the fluidized-bed drier, which means is regulated in its performance by the fluidized-bed temperature, is therefore provided with a device 3 for introducing the solid material into the fluidized-bed drier, which device has a capacity of at least 1.5 times the mass of the solid material to be introduced and which covers at least 25% of the surface 12 of the fluidized bed approximately uniformly with the introduced solid material in the case of the introduction of particulate, fluidizable or suspended solid material and at least 75% of said surface in the case of the introduction of lumpy solid material which is poorly fluidizable or is non-fluidizable.

The fluidized bed covers heating elements arranged in the fluidized-bed drier by at least 250 to 1,000 mm. Further components of the device are a discharge device for the dried solid materials, the performance of which device is controlled by the predetermined height of the fluidized bed, and a mechanical dust separation means 13 for reducing the proportion of particles smaller than 0.5 mm in dust of the solid material to below 10% by weight, which dust is discharged with the vapor of the evaporable material via the discharge 8.

In a dedusting unit 9, the proportion of dust in the vapor removed from the fluidized-bed drier is reduced to below 50 mg/kg of vapor. The device according to the invention also includes a vapor recycling means 10 having a compressor 11 which increases the pressure of the vapor to such an extent that the amount of vapor which is compressed through the device is at least twice that required for converting the solid on the fluidization base from a fixed bed to a fluidized bed, and a condenser 18 which, by condensing the material evaporated in the fluidized bed, separates the gaseous impurities from the vapor and conveys them, optionally with the aid of an extraction means 14, to the environment or for deodorization and/or to another gas purification and conveys the condensate via a pump 15 to the condenser and to further working up and utilization.

If the temperature level of the condensation of the vapor of the evaporable material is unsuitable for performing the required heat supply functions, the device according to the invention may be completed with a one-stage or multistage compressor 16 which increases the pressure of the vapor to such an extent that the condensation of the vapor can be carried out at the temperature level required to perform the heat supply function, for example for indirect heating of the fluidized bed. If this variant, too, is not advantageous for utilization of the recovered heat energy, after leaving the dedusting unit, the vapor of the evaporable material can be fed from the fluidized-bed drier to a steam turbine unit 17 in which, with performance of technical work, its pressure is reduced to such an extent that condensation is still possible at ambient temperature, for example 30° C.

EXAMPLE

The process according to the invention and the device according to the invention are described below with the aid of the FIG. 1.

The object of the Example is to prepare a dry brown coal having a water content of 10% by weight from a crude brown coal crushed in a conventional impact hammer mill to a particle size of 0 to 6 mm and having a water content of 55% by weight.

The mass flow of crude brown coal is 100 t/h and that of the dried brown coal is accordingly 50 t/h. Hence, in total 50 t of coal water/h have to be evaporated. The calculation of the subsequent evaporation shows that the water content after discharge from fluidized-bed drier 2 decreases by 1.5% by weight, so that the dried coal has to be discharged from fluidized-bed drier 2 with a water content of 11.5% by weight, and 249,152 kg of water/h have to be evaporated in the fluidized-bed drier. The 848 kg of water subsequently evaporating per hour outside fluidized-bed drier 2 are extracted and are fed to a separate dedusting unit 9 as vapors having an air content of 2 kg/kg of steam.

In accordance with the specifications laid down for the feed member, 200 $m^3$ of air/h are introduced into the fluidized-bed drier 2 together with the coal, which corresponds to a volume of 142.9 $m^3$ at a cut weight of 0.7 kg/liter. The coal water, the evaporable material in the Example, should contain 20 $m^3$ of dissolved gaseous impurities, in particular carbon dioxide, so that the steam generated from coal water by drying in one hour contains a total of 220 $m^3$ of gaseous impurities which are laden with steam according to the saturation temperature and are separated in condenser 18 and released into the environment.

With a heat transmission coefficient of $k=300$ $W/m^2 \cdot K$ for the condensing heating vapor at the fluidized coal bed and a heat demand of 800 W/kg of coal water to be evaporated, it is found that a heating area of 3,277 $m^2$ must be installed in the fluidized-bed drier 2 at a temperature difference of 40 K. which is effective for the heat transfer.

When a heating element 7 is at a height of 2.00 m, a heating surface density of 100 $m^2$ for fluidization base 5 should be reached, i.e. the fluidized-bed drier 2 has an approximately 32 $m^2$ fluidization base 5, giving a length of 8 m for fluidization base 5 with a width of fluidization base 5 of 4 m. If the solid material on fluidization base 5 reaches its fluidization point at an empty pipe velocity of 0.35 m/s, according to the invention, 80,670 $m^3$ of steam, corresponding to 53.8 t/h, must be recirculated. About 103 t of steam/h, corresponding approximately to a volume of 150,000 $m^3$/h, must therefore be removed from the fluidized-bed drier 2 and substantially dedusted. Only the vapor formed by evaporation of 49,152 kg of coal water and contaminated with 220 $m^3$ of noncondensable gaseous impurities is fed to the condenser 18.

The heat energy requirement of the fluidized-bed drying unit according to the invention is 39.3 $MW/h_{th}$, of which about 30.8 $MW/h_{th}$, i.e. 78% of the heat energy expended, can be recovered in condenser 18 at a temperature level of up to 95° C., so that this object of the invention is achieved.

If the noncondensable gaseous impurities are released into the environment at a saturation temperature of 60° C., about 275 $m^3$/h are emitted. This is 0.2% of the usual emissions, based on a tubular drier unit of comparable capacity which emits about 170,000 $m^3$ of vapors/h, corresponding to pollution of the environment of 8.5 kg of coal dust/h at a dust content of 50 $mg/m^3$.

The substance-specific boiling curve of the coal to be dried in the Example requires a fluidized-bed temperature of 118° C. A heating vapor at a minimum pressure of 0.59 MPa is required in order to achieve the specified temperature difference of 40 K. between the fluidized bed 6 and the heating element 7.

Owing to the specified height of 2.0 m for heating element 7 and a free space present between the heating element 7 and the fluidization base 5 and having a height of 250 mm, the height of the fluidized bed must be adjusted to at least 2,500 mm, but not more than 3,250 mm, by the controlled discharge of dried coal.

I claim:

1. Process for the drying of solid material, which solid material includes less than 98% by weight of an evaporable material, said process comprising feeding said solid material to a fluidized-bed drier, in which an indirectly heated fluidized bed is formed which contains the solid material fluidized by a fluidizing medium, the fluidizing medium being the evaporable material in vapor form; discharging the dried material from the fluidized-bed drier; feeding the dried material, if required after cooling, to a subsequent use selected from the group consisting of a further processing stage, for utilization and for disposal in a landfill; separating components of the vapor which are non-condensable and insoluble in the condensate of the evaporable material by cooling and condensation of the vapor, and removing said non-condensable and insoluble components for a subsequent use selected from the group consisting of releasing into the environment, feeding to a deodorization stage and feeding to another gas purification process; adjusting the temperature of the fluidized bed, depending on the desired proportion by weight of the evaporable material in the solid material discharged from the fluidized bed, by adding solid material having a higher proportion by weight of evaporable material to the fluidized bed and removing dried solid material from the fluidized bed, so that said temperature of the fluidized bed corresponds to the boiling curve of the evaporable material in the solid material removed from the fluidized bed, so that the vapor removed from the fluidized-bed drier also contains gaseous substances of the evaporable material, other gaseous impurities and only gaseous components of the solid constituents of the solid material which are volatile below the boiling curve.

2. Process according to claim 1, wherein the solid material is introduced as fluidizable, particulate bulk material into the fluidized-bed drier, and said solid material itself forms the fluidized bed.

3. Process according to claim 1, wherein the solid material fed to the fluidized bed is a mixture of dried solid material discharged from the fluidized-bed drier and fresh, undried solid material.

4. Process according to claim 1, wherein the solid material fed to the fluidized-bed drier is sprayed with condensate of the evaporable material as pumpable sludge above the fluidized bed in the fluidized-bed drier, and the solid material itself forms the fluidized bed.

5. Process according to claim 1, wherein the solid material is introduced as coarse poorly fluidizable pieces into the fluidized bed which is formed from fluidizable, particulate material having a density which is 1.2 to 5.0 times higher than that of the coarse material.

6. Process according to claim 5, wherein the dried coarse solid material is discharged from the fluidized bed in conjunction with a part of the particulate, fluidizable material, the coarse and fluidizable material are then separated and the fluidizable material is recycled into the fluidized bed.

7. Process according to claim 1, wherein the fluidizing medium is fed to the process from outside.

8. Process according to claim 1, wherein the vapor removed from the fluidized bed is used for indirect heating of the fluidized bed and the removed vapor is adjusted so that its pressure is, in the range from 0.2 to 4.0 MPa, and its temperature, is in the range from 125° to 225° C. so that the mean temperature difference between vapor used for indirect heating of the fluidized bed and fluidized bed is 10 to 150 K.

9. Process according to claim 1, wherein the pressure in the fluidized bed corresponds approximately to the ambient pressure of the atmosphere.

10. Process according to claim 1, wherein the pressure of the vapor of the fluidizable material, which vapor is removed from the fluidized-bed drier, is increased by supplying mechanical energy, after removal of solid components of the solid materials but before an indirect transfer of its latent heat energy to another heat medium.

11. Process according to claim 10, wherein the vapor of the evaporable material whose pressure has been increased is used for the indirect heating of the fluidized bed.

12. Device for carrying out the process according to claim 1, said device comprises:

a) a means for feeding the solid material to be dried to the fluidized-bed drier said means is regulated as a function of the fluidized-bed temperature;

b) a device for introducing the solid material into the fluidized-bed drier, which device has a capacity of at least 1.5 times the mass of the solid material to be introduced, and covers as least 25% of the surface of a fluidized bed approximately uniformly with the introduced solid material in the case of the introduction of particulate, fluidizable material and at least 75% of said surface in the case of the introduction of lumpy solid material which is poorly fluidizable;

c) a fluidized-bed which covers a heating element by at least 250 to 1,000 mm;

d) a discharge device for dried solid material, the performance of which device is controlled by a predetermined height of the fluidized bed;

e) a mechanical dust separation means for reducing a proportion of particles smaller than 0.5 mm in the solid material dust discharged with the vapor of the evaporable material via a discharge to below 10% by weight;

f) a dedusting unit for reducing the dust content in the vapor released from the fluidized-bed drier to below 50 mg/kg of vapor;

g) a vapor recycling means having a compressor (11) which increases the pressure of the vapor to such an extent that the amount of vapor circulating through the device is at least twice the amount required for converting the solid on the fluidization base from a fixed bed into a fluidized bed; and h) an indirectly cooled condenser which separates the gaseous impurities from the vapor by condensation of the evaporated material and feeds them via an extracting means to a subsequent use selected from the group consisting of feeding to the environment, a deodorization stage and another gas purification, and a pump which feeds some of the condensate back to the condenser.

13. Device according to claim 12, wherein the device further comprises a compressor selected from the group consisting of a one-stage compressor and a multistage compressor which increases the pressure of the vapor present after the dedusting unit to such an extent that it can be used for indirect heating of the fluidized bed.

14. Device according to claim 12, further comprising, a steam turbine unit consisting of an expansion turbine, a generator for generating electric energy and a condenser.

15. Process according to claim 1, wherein the evaporable material comprises water.

16. Process according to claim 1, wherein the solid material is selected from the group consisting of brown coal, peat, filter cakes from mechanical separation and sludges.

17. Process according to claim 1, wherein the pressure of the vapor of the fluidizable material, which vapor is removed from the fluidized-bed drier, is reduced by expansion with release of mechanical energy, after removal of solid components of the solid materials but before an indirect transfer of its latent heat energy to another heat medium.

* * * * *